US005775313A

United States Patent [19]

Bresette et al.

[11] Patent Number: 5,775,313

[45] Date of Patent: Jul. 7, 1998

[54] METHOD AND APPARATUS FOR PROTECTING ARROWS IN A QUIVER

[76] Inventors: Douglas T. Bresette, 45 Rialto Dr., Watsonville, Calif. 95076; John Mello, III, 464 Seeley Ave., Aromas, Calif. 95004

[21] Appl. No.: 733,802

[22] Filed: Oct. 18, 1996

[51] Int. Cl.[6] ..... F41B 5/06

[52] U.S. Cl. ..... 124/86; 124/25.7; 206/315.11; 224/916

[58] Field of Search ..... 124/25.5, 25.7, 124/23.1, 86, 88; 206/315.11; 224/916

[56] References Cited

U.S. PATENT DOCUMENTS

| | | | |
|---|---|---|---|
| 3,465,928 | 9/1969 | Osterholm | 224/916 X |
| 4,073,328 | 2/1978 | Franklin | 124/25.7 X |
| 4,156,496 | 5/1979 | Stinson | 124/25.7 |
| 4,522,187 | 6/1985 | Tafel | 124/25.5 |
| 4,995,372 | 2/1991 | Topel | 124/25.5 |

*Primary Examiner*—John A. Ricci
*Attorney, Agent, or Firm*—Donald R. Boys

[57] ABSTRACT

A quiver apparatus for mounting on a bow has a mounting interface adapted for attaching the apparatus to the bow and one or more retainers adapted for holding arrows. A support extending away from the one or more retainers and mounting interface is formed such that, with the support resting on a surface, an arrow held in the one or more retainers is held above the surface with no portion of the arrow, including fletching, touching the surface. In some embodiments the support comprises two legs, and the legs may be substantially parallel and directed at substantially a right angle to a plane defined by the shape of the bow. In some embodiments boots are provided for attaching to leg extensions, adapted for providing increased surface area contact.

25 Claims, 4 Drawing Sheets

METHOD AND APPARATUS FOR PROTECTING ARROWS IN A QUIVER

FIELD OF THE INVENTION

The present invention is in the area of apparatus and methods for archery arrow carriage on a bow. It pertains more particularly to a device for protecting arrows carried on a bow-mounted quiver from damage.

BACKGROUND OF THE INVENTION

Since the early day of archery, archers have struggled with the problem of transporting arrows on or near an archer so they will be available when they are needed. Many arrow carriage devices and methods have been developed and used. Archers have carried arrows in their hands, stuffed them in a waist belt or in a box, or the like. Archers for centuries have carried arrows in a pouch, commonly referred to as a quiver, made of cloth, leather, or the like. Quivers of this type completely enclose arrows and protect the arrow heads, shafts, and fletchings, as well as protecting an archer from being injured by a sharp arrow point. Quivers have typically been designed to be affixed on an archer's body at places such as a waist belt, over a shoulder, across their back, and other places. Quivers have also been attached to portage mechanisms, such as a horse or a carriage.

In a present popular configuration, many types of quivers are attached to a bow, with the arrows traversing the length of the bow on the side opposite the arrow rest and sights. This type of quiver, referred to herein as a bow-mounted quiver, comprises an arrow shaft holder and an arrowhead support, and may be made in a variety of ways. In some products the arrow shaft holder and the arrowhead support are two separate pieces mounted separately to the bow, and in others the shaft holder and the arrowhead support are mounted to a common frame which is in turn mounted to the bow by a common bracket or other mounting assembly. The shaft holder typically includes several arrow shaft notches aligned in a single row and is typically made of a material like natural or synthetic rubber, which has enough flexure to allow arrow shafts to be snapped into place in the notches. These notches typically hold arrow shafts just below the fletching, with the fletching between the notches and the arrow's bow string notch.

An arrow head support typically includes a component which by nature of its retentivity, holds the tip of the arrows in place. Many such arrowhead supports include a block of styrofoam, for example, and the tips of the arrowheads penetrate the styrofoam. Bow-mounted quivers are typically not enclosed with leather, cloth, or the like. This is to keep the additional weight of a quiver mounted on a bow to a minimum. The arrow shafts and fletching, which extend several inches above the arrow shaft holder to the arrow's bow string notch, are thus exposed to the elements.

A problem in using a bow-mounted quiver occurs when a bow and arrow is used in the field, such as when hunting or target shooting. During these circumstances an archer occasionally needs to set a bow down on the ground or against something to perform tasks that require use of the bow hand. When this happens, the arrows in the quiver, which are exposed on the side of the bow, are often laid against the ground or another object, such as a fence, rock, or tree. This usually exposes the fletching and the shafts to potential damage should enough stress be placed on the fletching end of the arrows. Arrows are also subject to damage similarly when a bow hunter is crawling on the ground, or moving through heavy brush while stalking a prey.

What is needed is an apparatus that protects an arrow shaft, bowstring notch, and fletching from damage when the quiver side of a bow with a bow-mounted quiver encounters objects, such as the ground, a tree, a bush, or the like.

SUMMARY OF THE INVENTION

In a preferred embodiment of the present invention a quiver apparatus for mounting on a bow is provided, comprising a mounting interface adapted for attaching the apparatus to the bow; one or more retainers adapted for holding arrows; and a support extending away from the one or more retainers and mounting interface. With the support resting on a surface, an arrow held in the one or more retainers is held above the surface with no portion of the arrow, including fletching, touching the surface.

The support in some embodiments has two legs. And the legs may be substantially parallel and directed at substantially a right angle to a plane defined by the shape of the bow. The one or more retainers may include a retainer strip having notches for engaging arrow shafts, and the mounting interface the retainer strip, and the support may formed as a single contiguous element. The elements may be separate or contiguous in a number of different combinations.

Bumpers are provided for engaging the legs in some for providing a replaceable contact component for contacting the surface. The bumpers are adapted in many embodiments to provide an enlarged supporting surface adapted for contacting the surface.

For existing equipment a standoff bracket is provided for mounting to a portion of a quiver, comprising a mounting portion adapted to attach to the portion of the quiver; and a support extending away from mounting portion. With the support resting on a surface an arrow held in a quiver to which the support is attached is held away from the surface.

The apparatus and methods made available to archers by the present invention provide the first ability for protecting arrows in bow-mounted quivers from surfaces such as the ground and pavement, and from objects such as trees, brush, and rocks, particularly while a bow with such a quiver is in use in a hunting environment.

DESCRIPTION OF THE PREFERRED EMBODIMENTS

Figure 1A:
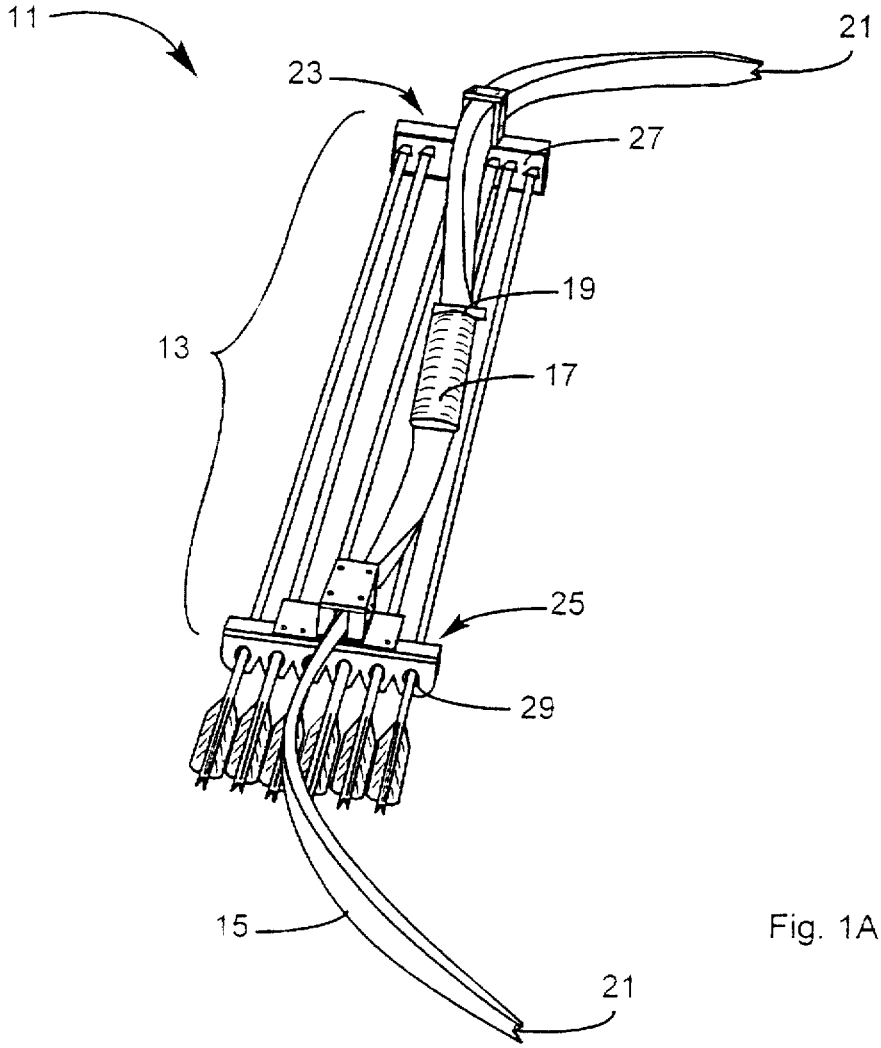
Fig. 1A (PRIOR ART)
FIG. 1A is a perspective view of a bow and bow-mounted quiver configuration according to current art.

The present invention provides a method and apparatus that protects arrows in a bow-mounted quiver. FIG. 1A is a perspective view of a bow and bow-mounted quiver configuration according to current art, which comprises a bow 11 and a bow-mounted quiver 13.

Bow 11 includes bow stalk 15, bow hilt 17, arrow rest 19, and bow-string notches 21. Bow stock 15 provides the structure with the elasticity to provide the force to propel an arrow in a manner well known in the art. It also provides a means to affix bow accessories. Bow hilt 17 provides a convenient grip for bow 11. Arrow rest 19 provides a resting place for an arrow while an archer draws the bow and takes aim. Bow-string notches 21 provide a secure place to secure a bow string, not shown. It will be apparent to those with skill in the art that there are a number of other devices which may be mounted to a bow, such as sights, not shown.

The bow shown in the figures herein is a rather conventional one-piece bow. It is to be understood, however, that this illustration is for simplicity and convenience, and the invention applies as well to bows of many sorts, such as compound bows, to which quivers may be affixed.

In conventional art, a bow-mounted quiver 13 typically includes an arrow tip support 23 and an arrow shaft holder 25. Arrow tip support 23 is mounted to bow stalk 15 and holds a replaceable elastomeric material 27 in which the tips of arrows are embedded. Arrow shaft holder 25 is mounted to bow stalk 15 and includes arrow shaft notches 29. Shaft notches 29 arc shaped, in a maimer well known in the art, to allow an arrow to be inserted, retained and removed. The material used for holder 25 typically has sufficient elasticity to hold arrow shafts securely in place, once inserted.

Figure 1B:
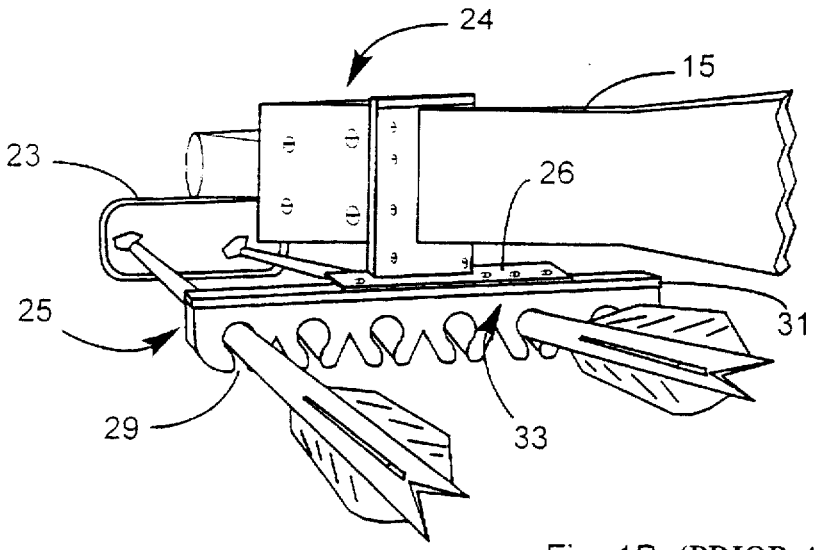
Fig. 1B (PRIOR ART)
FIG. 1B is a partial view from a different perspective of the bow and quiver of FIG. 1A.

FIG. 1B is a partial view from a different perspective of the bow and quiver of FIG. 1A, showing additional detail of arrow shaft holder 25. Shaft holder 25 in conventional art comprises stiffener 31, typically a metal or plastic plate, elastomeric material 33, and arrow shaft notches 29. Stiffener 31 provides a sufficiently rigid backplane to hold elastomeric material 33, to which it is attached, in position. Notches 29 each provide a cincture to compress around the circumference of an arrow shaft to secure it in place. Shaft holder 25 is fastened, by any suitable means, to a mounting bracket plate 26 of a mounting bracket 24. It will be apparent to those with skill in the art that the mounting bracket and various parts thereof may be designed in several different ways.

Figure 2A:
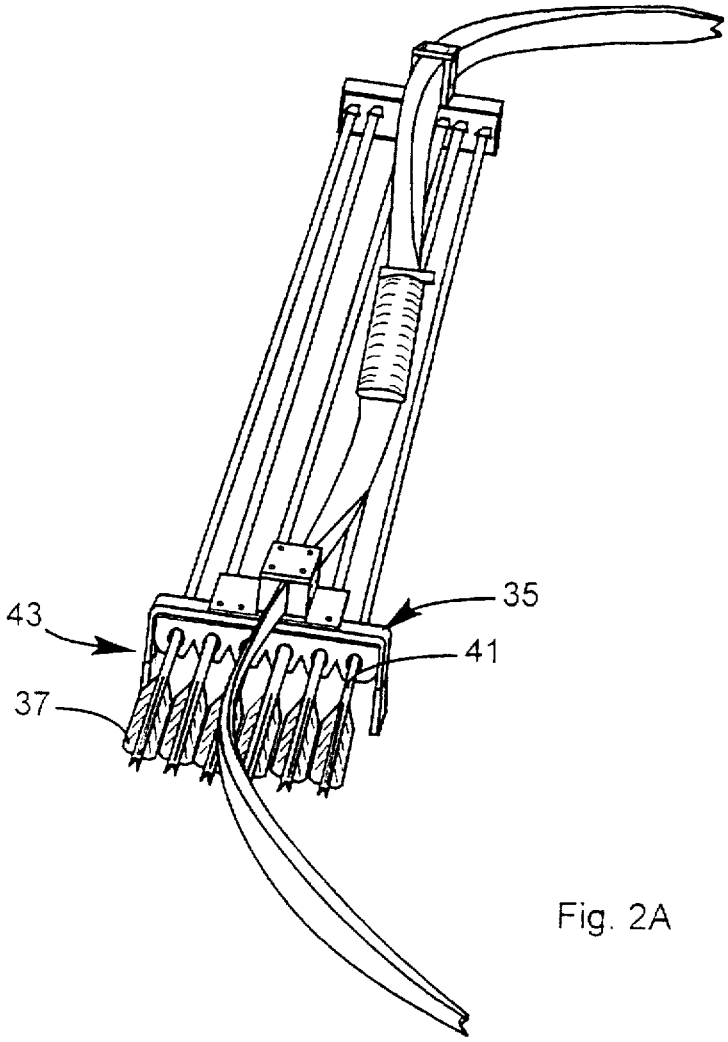
FIG. 2A is a perspective view of a bow and quiver configuration according to the present invention.

FIG. 2A is a perspective view of a bow and quiver configuration according to an embodiment of the present invention. In this embodiment a Quiver support 35 is added as an apparatus for protecting arrows in the quiver. Quiver support 35 in this embodiment is mounted on top of stiffener 31 (FIG. 1B), in conjunction with arrow shaft holder 25. Quiver support 35 includes extensions that protrude beyond arrow fletching 37, thereby protecting arrow fletchings and arrow shafts 41 when the bow-mounted quiver shown contacts a surface, such as the ground or tree, with sufficient force to cause damage to the arrows.

Figure 2B:
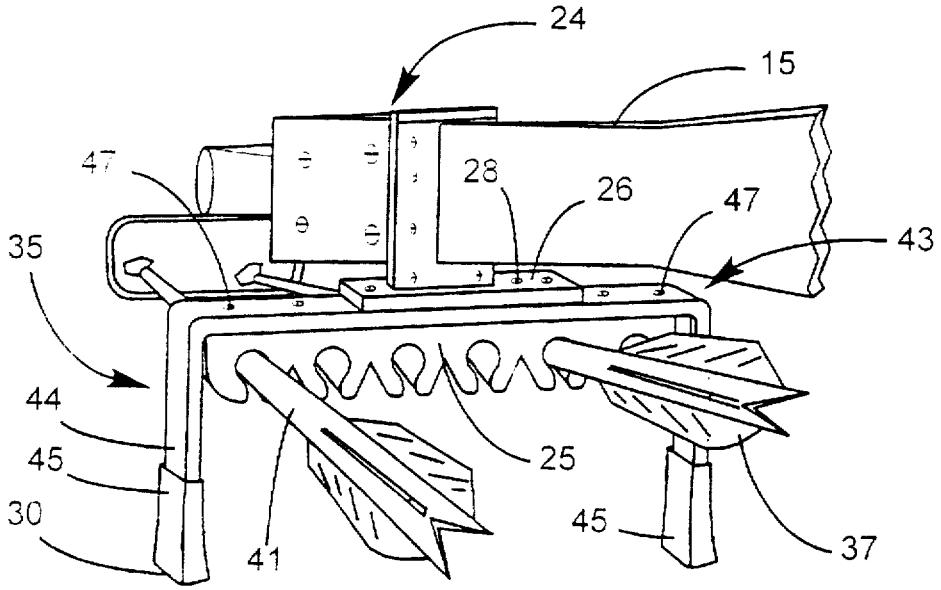
FIG. 2B is a partial view from a different perspective of the bow and quiver of FIG. 2A.

FIG. 2B is a partial view from a different perspective of the bow and quiver of FIG. 2A showing additional detail of quiver support 35, comprising stand-off bracket 43 and bumpers 45. Quiver support 35 in this embodiment replaces stiffener 31 (FIG. 1B) and is fastened to mounting bracket plate 26 using screws 28. Quiver support 35 includes extension legs 44 that protrude beyond arrow fletching 37 to protect them and arrow shafts 41 from damage when a bow-mounted quiver contacts a surface with sufficient force to cause damage to the arrows. A quiver support in this embodiment is made from any material of sufficient strength and rigidity, such as aluminum or plastic to protect arrow shafts and fletchings from damage due to contact with a surface, such as the ground or a tree. Bumpers 45 provide scratch or dent protection to surfaces, such as a wall or table, where esthetics are deemed important.

Figure 2C:
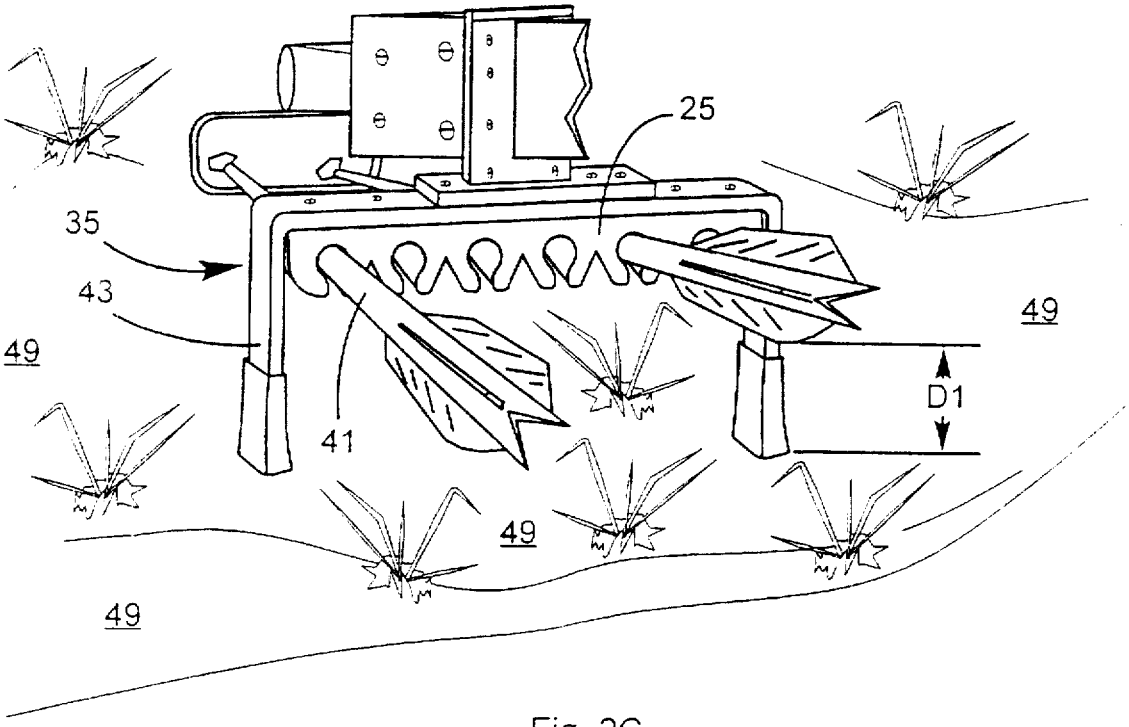
FIG. 2C is a partial view from a different perspective of the bow and quiver of FIG. 2A illustrating a method according to the present invention.

FIG. 2C is a partial view from a different perspective of the bow and quiver of FIG. 2A showing a method according to the present invention wherein a quiver support 35 protects arrow shafts 41 and fletchings 37. Ground surface 49 is kept away from fletchings 37 and shafts 41 by at least distance D1 by extensions 43. This support prevents the arrows from contacting the ground or other objects. Ground surface 49 could also be a table, brush fence or any object that might damage arrows without quiver support 35.

Figure 2D:
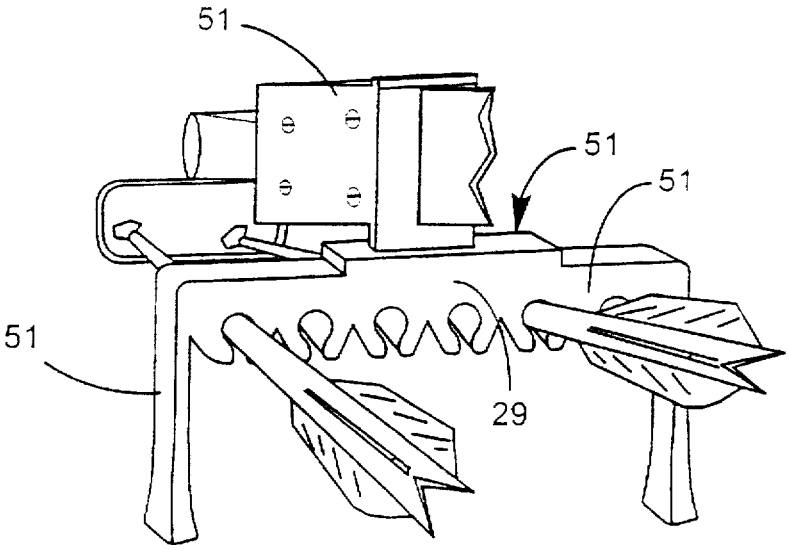
FIG. 2D is a partial view from a different perspective of FIG. 2A showing an alternative configuration according to the present invention.

FIG. 2D is a partial view from a different perspective of the bow and quiver of FIG. 2A showing an alternative embodiment of the invention. In this embodiment quiver support 35, shaft holder 25, bumpers 45, and mounting bracket 24 with mounting plate 26 (FIG. 2B) are integrated into one piece as quiver support assembly 51. Quiver support assembly 51 is made of any material that has the strength to protect arrow shafts and fletching, and still has the elasticity to hold arrow shafts 41 (FIG. 2D) securely in notches 29 (FIG. 1B). A quiver support in this embodiment is a stand-alone device that is provided as part of a complete bow-mounted quiver.

Figure 2E:
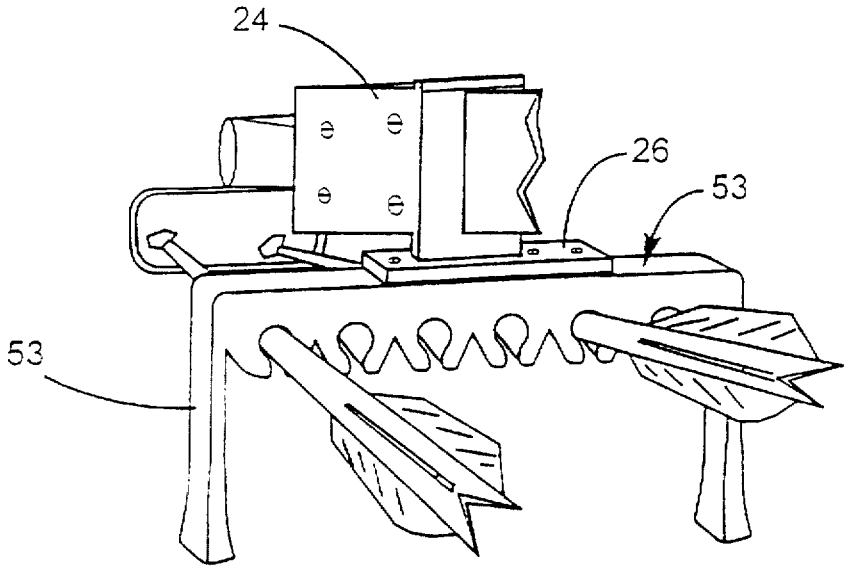
FIG. 2E is a partial view of the bow and quiver of FIG. 2A illustrating yet another embodiment of the present invention.

FIG. 2E is a partial view from a different perspective of the bow and quiver of FIG. 2A showing yet another alternative embodiment of the present invention. In this embodiment, quiver support 35, shaft holder 25, bumpers 45, and mounting plate 26 (FIG. 2B) are integrated into one piece as quiver support assembly 53. Quiver support assembly 53 is made from any material with the strength to protect arrow shafts and fletching, and still have the elasticity to hold arrow shafts 41 (FIG. 2D) securely in notch 29 (FIG. 1B). A quiver support in this embodiment is an additional accessory that is provided separately from a quiver support. It is fastened to mounting plate bracket 26 using screws 48 and replaces arrow shaft holder 25.

In other embodiments of the invention, because arrows are not the only components of a bow assembly, standoffs and standoff brackets may be provided within the scope of the invention adapted to mount directly to a bow stalk with or without a quiver. In these embodiments such an apparatus protects relatively vulnerable portions of a bow assembly, such as arrow rests and sights, as well as various combinations of pulleys and other apparatus that may be included with archery bows. In particular such supports are useful when it is necessary to lean a bow assembly on an other object, such as a tree, or when it may be necessary to lay the bow assembly on the ground, the bed of a truck, and so forth.

It will be apparent to those with skill in the art that there are many alterations that may be made in the embodiments described herein without departing from the spirit and scope of the present invention. For example, in a preferred embodiment bumper 45 is shown on the tips of quiver support extensions 43. Other embodiments may not have a bumper to protect surfaces in which a quiver support may come in contact. In an other example, extensions 43 may be of any suitable geometric configuration, rather than that shown in the embodiments above, as long as it is extended to provide reasonable protection to arrow shafts and fletchings in a bowmounted quiver. In still another example, the method of mounting a quiver support to a bow-mounted quiver can be any of many methods, such as using clamps, bolts, latches, and the like, without departing from the spirit and scope of the invention.

In further embodiments bumpers 45 can be adapted to have more surface area, or the legs 45 may be curved or turned to present considerable more surface area to any ground plane or object adjacent to which the bow and quiver may be placed. Bumpers with more surface area serve to protect even on a muddy surface, on snow, and in other difficult situations.

What is claimed is:

1. A quiver apparatus for mounting on a bow, comprising:

a mounting interface adapted for attaching the apparatus to the bow;

one or more retainers adapted for holding arrows; and a support extending away from the one or more retainers and mounting interface;

wherein with the support resting on a surface, an arrow held in the one or more retainers is held above the surface with no portion of the arrow, including fletching, touching the surface, wherein the one or more retainers include a retainer strip having notches for engaging arrow shafts, and wherein the mounting interface, the retainer strip, and the support are formed as a single contiguous element.

2. A quiver apparatus for mounting on a bow, comprising:

a mounting interface adapted for attaching the apparatus to the bow;

one or more retainers adapted for holding arrows; and a support extending away from the one or more retainers and mounting interface;

wherein with the support resting on a surface an arrow held in the one or more retainers is held above the surface with no portion of the arrow, including fletching, touching the surface, wherein the one or more retainers include a retainer strip having notches for engaging arrow shafts, and wherein the mounting interface, retainer strip, and the support are formed of one material in a single contiguous piece.

3. A quiver apparatus for mounting on a bow, comprising:

a mounting interface adapted for attaching the apparatus to the bow;

one or more retainers adapted for holding arrows; and a support extending away from the one or more retainers and mounting interface;

wherein with the support resting on a surface an arrow held in the one or more retainers is held above the surface with no portion of the arrow, including fletching, touching the surface, wherein the one or more retainers include a retainer strip having notches for engaging arrow shafts, and wherein the mounting interface and support comprise one contiguous piece and the retainer strip is a separate piece adapted to mount to the support.

4. A quiver apparatus for mounting on a bow, comprising:

a mounting interface adapted for attaching the apparatus to the bow;

one or more retainers adapted for holding arrows; and a support extending away from the one or more retainers and mounting interface;

wherein with the support resting on a surface an arrow held in the one or more retainers is held above the surface with no portion of the arrow, including fletching, touching the surface, wherein the one or more retainers include a retainer strip having notches for engaging arrow shafts, and wherein the support and retainer strip are formed of one material in a single contiguous piece, and the mounting interface is a separate piece adapted to mount to the support and to the bow.

5. A quiver apparatus for mounting on a bow, comprising:

a mounting interface adapted for attaching the apparatus to the bow, one or more retainers adapted for holding arrows; and a support comprising two legs extending away from the one or more retainers and mounting interface;

wherein with the support resting on a surface, an arrow held in the one or more retainers is held above the surface with no portion of the arrow, including fletching, touching the surface, and further comprising bumpers at the ends of the legs, the bumpers adapted for providing a replaceable contact component for contacting the surface.

6. The quiver apparatus of claim 5 wherein the bumpers are adapted to provide an enlarged supporting surface adapted for contacting the surface.

7. A quiver apparatus for mounting on a bow, comprising:

a mounting, interface adapted for attaching the apparatus to the bow;

one or more retainers adapted for holding arrows; and a support comprising two legs extending away from the one or more retainers and mounting interface;

wherein with the support resting on a surface, an arrow held in the one or more retainers is held above the surface with no portion of the arrow, including fletching, touching the surface, and wherein the legs are formed at the ends into feet having an enlarged supporting surface adapted for contacting the surface.

8. A standoff bracket for mounting to a portion of a quiver, comprising:

a mounting portion comprising a substantially straight central bridge element having a length and adapted to attach to the portion of the quiver; and a support comprising two or more leg extensions substantially parallel and extending in a direction substantially at a right angle to the length of the central bridge element, and extending away from mounting portion;

wherein, with the support resting on a surface an arrow held in a quiver to which the support is attached is held away from the surface.

9. The standoff bracket of claim 8 wherein the leg extensions at the ends away from the central bridge element are formed with feet presenting each an area in a plane substantially parallel to the length of the central bridge element greater than a cross sectional area of the associated leg extension.

10. The standoff bracket of claim 8 wherein the leg extensions are substantially parallel extending from opposite ends of the central bridge element.

11. The standoff bracket of claim 8 further comprising boot elements adapted to engage the ends of the leg extensions, providing thereby a replaceable element for contacting a surface.

12. The standoff bracket of claim 11 wherein the boot elements are adapted to increase the area of contact to a surface over the area of contact without the boot elements.

13. An archery bow assembly having an attached quiver, comprising:

a bow stalk; and a quiver adapted for mounting to the bow stalk;

wherein the quiver comprises:

a mounting interface adapted for attaching the apparatus to the bow;

one or more retainers adapted for holding arrows; and a support extending away from the one or more retainers and mounting interface;

wherein with the support resting on a surface, an arrow held in the one or more retainers is held above the surface with no portion of the arrow, including fletching, touching the surface, wherein the one or more retainers include a retainers strip having notches for engaging arrow shafts, and wherein the mounting interface, the retainer strip, and the support are formed as a single contiguous element.

14. An archery bow assembly having an attached quiver, comprising:

a bow stalk; and a quiver adapted for mounting to the bow stalk;

wherein the quiver comprises;

a mounting interface adapted for attaching the apparatus to the bow;

one or more retainers adapted for holding arrows; and a support extending away from the one or more retainers and mounting interface;

wherein with the support resting on a surface, an arrow held in the one or more retainers is held above the surface with no portion of the arrow, including fletching, touching the surface, wherein the one or more retainers include a retainer strip having notches for engaging arrow shafts, and wherein the mounting interface, retainer strip, and the support are formed of one material in a single contiguous piece.

15. An archery bow assembly having an attached quiver, comprising:

a bow stalk; and a quiver adapted for mounting to the bow stalk;

wherein the quiver comprises:

a mounting interface adapted for attaching the apparatus to the bow;

one or more retainers adapted for holding arrows; and a support extending away from the one or more retainers and mounting interface;

wherein with the support resting on a surface, an arrow held in the one or more retainers is held above the surface with no portion of the arrow, including fletching, touching the surface, wherein the one or more retainers include a retainer strip having notches for engaging arrow shafts, and wherein the mounting interface and support comprise one contiguous piece and the retainer strip is a separate piece adapted to mount to the support.

16. An archery bow assembly having an attached quiver, comprising:

a bow stalk; and a quiver adapted for mounting to the bow stalk;

wherein the quiver comprises:

a mounting interface adapted for attaching the apparatus to the bow;

one or more retainers adapted for holding arrows; and a support extending away from the one or more retainers and mounting interface;

wherein with the support resting on a surface, an arrow held in the one or more retainers is held above the surface with no portion of the arrow, including fletching, touching the surface, wherein the one or more retainers include a retainer strip having notches for engaging arrow shafts, and wherein the support and retainer strip are formed of one material in a single contiguous piece, and the mounting interface is a separate piece adapted to mount to the support and to the bow.

17. An archery bow assembly having an attached quiver, comprising:

a bow stalk; and a quiver adapted for mounting to the bow stalk;

wherein the quiver comprises:

a mounting interface adapted for attaching the apparatus to the bow;

one or more retainers adapted for holding arrows; and a support comprising two legs extending away from the one or more retainers and mounting interface;

wherein with the support resting on a surface, an arrow held in the one or more retainers is held above the surface with no portion of the arrow, including fletching, touching the surface, and further comprising bumpers at the ends of the legs, the bumpers adapted for providing a replaceable contact component for contacting the surface.

18. The quiver apparatus of claim 17 wherein the bumpers are adapted to provide an enlarged supporting surface adapted for contacting the surface.

19. An archery bow assembly having an attached quiver, comprising:

a bow stalk; and a quiver adapted for mounting to the bow stalk;

wherein the quiver comprises:

a mounting interface adapted for attaching the apparatus to the bow;

one or more retainers adapted for holding arrows; and a support comprising two legs extending away from the one or more retainers and mounting interface;

wherein with the support resting on a surface, an arrow held in the one or more retainers is held above the surface with no portion of the arrow, including fletching, touching the surface, and wherein the legs are formed at the ends into feet having an enlarged supporting surface adapted for contacting the surface.

20. A method for protecting arrows and arrow fletchings in a quiver mounted to a bow, comprising steps of:

(a) fashioning a support adapted to mount to a quiver; and (b) mounting the support to the quiver in a manner such that, with the bow placed on a surface on the side of the quiver, the support holds arrows away from the surface.

21. A standoff bracket for mounting to an archery bow having a bowstalk, comprising:

a mounting interface comprising a substantially straight central bridge element having a length and adapted for attaching the apparatus to the bowstalk; and a support comprising two or more leg extensions substantially parallel and extending in a direction substantially at a right angle to the length of the central bridge element, and extending away from mounting interface;

wherein, with the support resting on a surface, the bow is held substantially above the surface.

22. The standoff apparatus of claim 21 wherein the leg extensions at the ends away from the central bridge element are formed with feet presenting each an area in a plane substantially parallel to the length of the central bridge element greater than a cross sectional area of the associated leg extension.

23. The standoff apparatus of claim 21 wherein the leg extensions are substantially parallel extending from opposite ends of the central bridge element.

24. The standoff apparatus of claim 21 further comprising boot elements adapted to engage the ends of the leg extensions, providing thereby a replaceable element for contacting a surface.

25. The standoff apparatus of claim 24 wherein the boot elements are adapted to increase the area of contact to a surface over the area of contact without the boot elements.

* * * * *